US007386958B2

(12) United States Patent
Quarles

(10) Patent No.: US 7,386,958 B2
(45) Date of Patent: Jun. 17, 2008

(54) PRE-MANUFACTURED SELF-FLASHED CURB ASSEMBLY FOR ROOFTOP DAYLIGHTING SYSTEMS

(75) Inventor: Wylie Wayne Quarles, Greenwood, SC (US)

(73) Assignee: VKR Holding A/S, Hoersholm (DK)

( * ) Notice: Subject to any disclaimer, the term of this patent is extended or adjusted under 35 U.S.C. 154(b) by 505 days.

(21) Appl. No.: 10/685,113

(22) Filed: Oct. 14, 2003

(65) Prior Publication Data

US 2005/0076583 A1 Apr. 14, 2005

(51) Int. Cl.
*E04B 7/18* (2006.01)
*E04D 13/14* (2006.01)

(52) U.S. Cl. ..... 52/198; 52/220; 52/219; 52/58

(58) Field of Classification Search ..... 52/58, 52/60, 62, 198, 200, 218, 219, 19, 656.1, 52/220.8

See application file for complete search history.

(56) References Cited

U.S. PATENT DOCUMENTS

| | | | | |
|---|---|---|---|---|
| 591,611 | A | 10/1897 | Stran | |
| 4,428,166 | A * | 1/1984 | Burghart | 52/19 |
| 4,488,791 | A | 12/1984 | Hinchliffe | |
| 4,549,379 | A * | 10/1985 | Hoy et al. | 52/200 |
| 4,559,753 | A | 12/1985 | Brueske | |
| 4,823,525 | A * | 4/1989 | Roberts et al. | 52/200 |
| 4,917,345 | A * | 4/1990 | Czech | 248/678 |
| 4,930,275 | A * | 6/1990 | Verby et al. | 52/200 |
| 5,016,406 | A * | 5/1991 | Calam et al. | 52/58 |
| 5,297,371 | A | 3/1994 | Borghetto | |
| 5,522,189 | A | 6/1996 | Mortensen et al. | |
| 5,675,940 | A | 10/1997 | Bahar et al. | |
| 5,687,514 | A | 11/1997 | Gillispie | |
| 5,706,610 | A * | 1/1998 | Mayle | 52/60 |
| 5,718,088 | A | 2/1998 | Jacobsen | |
| 5,791,092 | A | 8/1998 | Strieter | |
| 5,896,711 | A | 4/1999 | McClure | |
| 5,953,869 | A | 9/1999 | Balfour et al. | |
| 6,041,557 | A | 3/2000 | Brown et al. | |
| 6,067,759 | A | 5/2000 | House | |
| 6,151,838 | A | 11/2000 | Husein | |
| 6,212,834 | B1 | 4/2001 | Lindgren | |
| 6,343,439 | B1 | 2/2002 | Rutledge | |
| 6,374,549 | B1 * | 4/2002 | Mayle | 52/58 |
| 7,013,606 | B2 * | 3/2006 | Sigrist et al. | 52/58 |
| 2002/0121053 | A1 | 9/2002 | Florek | |
| 2004/0111981 | A1 * | 6/2004 | Faurholdt et al. | 52/58 |

* cited by examiner

*Primary Examiner*—Richard E. Chilcot, Jr.
*Assistant Examiner*—Chi Q Nguyen
(74) *Attorney, Agent, or Firm*—Turner Padget Graham & Laney, P.A.

(57) ABSTRACT

A pre-manufactured self-flashed curb assembly for rooftop daylighting systems is provided. The curb assembly includes a curb defining a clear opening therein of predetermined dimensions for use in attachment to roof trusses having common and standard inter-spacing. The curb includes beams having at least two apertures therethrough for receipt of roof attachment fasteners. Also included is a flashing skirt carried by the outside perimeter of the rectangular curb, for a complete, water-tight assembly.

21 Claims, 3 Drawing Sheets

PRE-MANUFACTURED SELF-FLASHED CURB ASSEMBLY FOR ROOFTOP DAYLIGHTING SYSTEMS

BACKGROUND

Rooftop daylighting systems, such as skylights and windows, enjoy popularity with both commercial and residential buildings. Such systems illuminate rooms with natural light and thus reduce the consumption of electricity associated with artificial lighting. They increase the perceived spaciousness of a room and may also be configured to enhance air circulation. Such daylighting systems may be used on many types of roofs, including an inclined shingled roof and a high profile tile application.

Rooftop daylighting systems involve an opening cut through the entire thickness of the roofing structure, including interior ceiling sheetrock, roof sheathing, and the like, between adjacent roof trusses. Typically, to maximize the amount of daylight transmitted, the opening is cut to the inside edges of adjacent roof trusses. In residential construction, for example, such trusses typically are positioned twenty-four inches on center, with twenty-two and a half inches of clear opening between them; to maximize the amount of illumination provided through the skylight, the skylight opening usually would be such twenty-two and a half inches in width.

At an opening so configured, a mounting structure known as a curb is typically constructed for receipt of a skylight or rooftop window itself. In a typical application, such a curb would be constructed of 2×4 or 2×6 stock lumber, with the shorter side edge of the lumber disposed against roof sheathing carried by the roof trusses, and with the longer side edge disposed perpendicular to the plane of the roof. At finishing, the exposed trusses, as well as the interior-facing curb members, are covered with sheetrock (also known as drywall) so as to present an attractive completed light shaft suitable for painting, wallpaper, or other treatments.

Conventionally, the members constituting the curb, such as 2×4 or 2×6 stock lumber, would be constructed in situ by "toenailing" into the roof structure, including the roof sheathing and roof trusses. "Toenailing" involves driving a nail obliquely through the side of the curb lumber into the roof sheathing and/or roof truss. However, toenailing causes difficulties. If the curb frame members are toenailed from the light shaft side of the curb frame member, the nailing and construction must be performed before any finishing sheetrock is installed to the interior of the daylighting system opening. On the other hand, if the toenailing is performed from the exterior side of the curb frame members, care must be taken that the nails are not driven so far through the structure as to protrude through the wooden members into the area to be occupied, or perhaps already occupied, by finishing sheetrock thereby breaking, spaulling, or otherwise damaging the finished surface of the light shaft. Furthermore, it has been found that toenailing from either the interior side or the exterior side requires a large number of nails to produce a resulting rooftop daylighting system that will satisfy wind uplift requirements of governmental entities or recommendations of trade associations such as the American Architectural Manufacturers Association. Considerable labor is also involved in making and installing a curb in a roof opening in situ, and often leads to final products of less than optimal quality.

Flashing is installed around the exterior perimeter of the curb at the roof to provide weatherproofing to the entire system. While adequate water-tight techniques and products have been developed and employed for suitably flashing a skylight opening, the systems are typically more labor intensive and time-consuming at the site. Particularly, such flashing must be installed by a tradesman piece-by-piece while upon the roof. The flashing is typically "mopped in" to the roof sheathing—roofing cement is spread upon the roof sheathing and the flashing pieces are pressed into the cement and nailed to the curb member piece-by-piece.

The problems and difficulties described above generally pertain both to original construction of a daylighting system and to re-construction on an older structure. The problems are exacerbated in a re-roofing application, in which old shingles are removed from a building and new shingles are installed. Typically in such re-roofing efforts, new skylights are installed, either for customer preference to update the skylighting system or to insure water tightness, as older skylights may be damaged from the re-roofing work and thereafter leak. However, replacement of the skylight during re-roofing is difficult. As stated above, typically the flashing is mopped into the roof sheathing and nailed to the curb on original construction. Removal of the old flashing and replacement with new flashing is often necessary to insure weatherproofing, but removal of the old flashing that has been mopped in to the roof sheathing and nailed to the curb tends to damage or destroy the curb. However, in a re-roofing application, the interior to the building has already been finished and used for years. Removing the old curb leaves interior sheetrock that has already been installed into the skylight opening, also referred to as the light shaft—as noted above, such sheetrock usually is used to cover the roof trusses and the curb used at the skylight opening to create the light shaft. To construct a new curb using the materials and techniques heretofore known requires either removal of the sheetrock so that toenailing may be accomplished on the interior side of the new curb frame members, or toenailing from the exterior side with the resultant risk of damaging the sheetrock/drywall from nailing overpenetration. Furthermore, the roofing tradesmen tend to prefer to avoid "inside" work, which is not within their specialty, and therefore prefer to avoid tampering with or repairing the sheetrock/drywall. Moreover, as with an initial application, numerous (for example, eighteen) nails must be used in order to satisfy uplift requirements and recommendations when toenailing is used.

The present invention relates to an improvement upon the known systems and methods for providing a flash curb assembly for rooftop daylighting systems and provides distinct advantages over the conventional systems and methods.

SUMMARY

In response to the discussed difficulties and problems encountered before, a new pre-manufactured self-flashed curb assembly for rooftop daylighting systems has been discovered.

The present invention provides for a pre-manufactured self-flashed curb assembly, to be installed as a single unit upon a new construction, or in re-roofing of an existing construction, or in retrofitting a newer skylight or roof window to an existing structure.

According to the present invention, a curb is provided. Defined within the curb is an opening of predetermined dimensions in accordance with conventional dimensions for roofing truss member spacing, such as twenty-four inches on center. So dimensioned, the curb provides for the maximum amount of clear opening for maximum light transmission and also is adapted for receipt of commercial skylighting systems of standard dimensions. The curb may be of any shape, including regular or irregular polygonal shapes. In one embodiment, a rectangular curb is provided with first and second pairs of standards or beams, each pair parallel and the respective pairs perpendicular, to form a rectangular curb configuration.

The beams of the rectangular curb each have at least two apertures, such as center-bored holes, therethrough, disposed parallel to the inside and outside faces of the beams, for receipt of roof attachment fasteners such as nails or screws. So configured, a roof attachment fastener, such as a nail, may be driven through an aperture directly into an underlying roof truss of the building. For ease of manufacture, it is preferred that the apertures are also disposed generally perpendicular to the cub and thereby also perpendicular to the plane of the roof upon which the curb is installed, but such perpendicularity is not required. So configured, the roof attachment fastener would not disturb sheetrock preexisting within the opening. Furthermore, it has been discovered that attachment of a roofing curb in such a fashion with ring shank nails allows for a minimum number of nails while still satisfying wind uplift requirements and industry recommendations.

Carried about the outside perimeter of the rectangular curb is a flashing skirt. The flashing skirt may include a plurality of individual flashing units, each having an L-shaped cross-section defining two legs, one leg of which resides in a plane parallel to the plane of the roof and the other leg attached to one of the corresponding rectangular frame standards or beams. The individual flashing units, disposed about the outside perimeter of the rectangular frame, are in waterproof attachment one to another, such that the finished flashing skirt provides a pre-manufactured waterproof assembly.

Additional objects and advantages of the invention will be set forth in part in the following description or may be obvious from the description and the included drawings.

DETAILED DESCRIPTION

Figure 1:
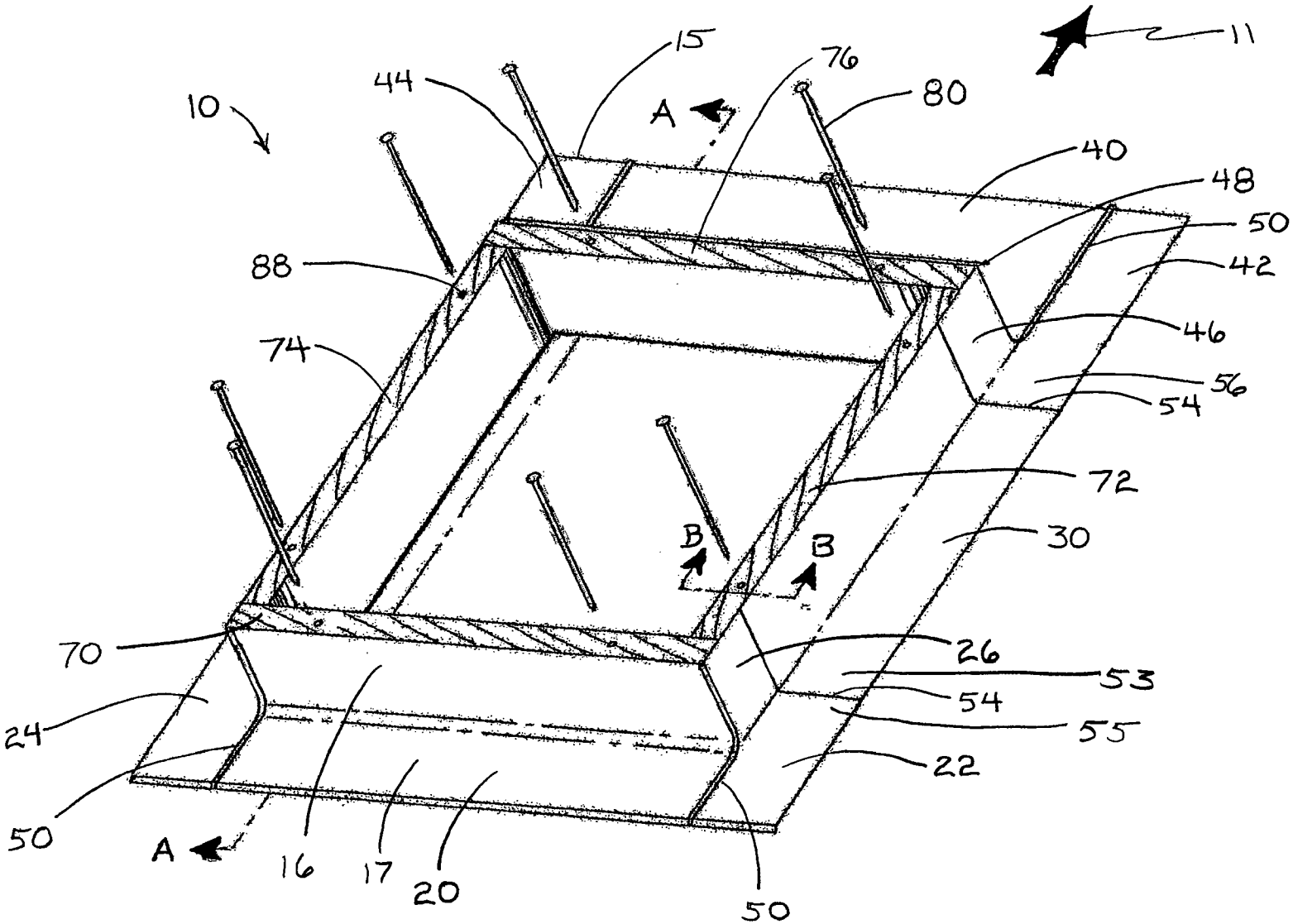
FIG. 1 is a perspective view of a pre-manufactured self-flashed curb assembly in accordance with one exemplary embodiment of the present invention.

Reference will now be made in detail to the presently preferred embodiments of the invention, one or more examples of which are illustrated in the drawings. Each example is provided by way of explanation of the invention, not by way of limitation. For example, features illustrated or described as part of one embodiment may be used on another embodiment to yield a still further embodiment. It is intended that the present application include such modifications and variations as come within the scope and spirit of the invention. Repeat use of reference characters throughout the present specification and appended drawings is intended to present the same or analogous features, elements, or steps of the invention.

FIG. 1 shows an exemplary embodiment of a curb assembly generally 10 that may be used in accordance with the present invention. The curb assembly 10 is adapted for installation about an opening through a roof. Upon an inclined roof, the curb assembly 10 is oriented such that the top gutter 40 is uppermost in the assembly, with the incline of the roof being upwards in the direction of arrow 11. The curb assembly 10 may be used with new construction or may be used in re-roofing applications upon existing, older structures, or may be used to retrofit newer daylighting systems to existing structures.

The curb assembly 10 includes four standards or beams in its rectangular frame, such as sill curb beam 70, right curb beam 72, left curb beam 74, and gutter curb beam 76. The beams 70, 72, 74, and 76 may be high quality clear stain grade smooth surface wooden beams of standard commercial dimensions, such as 2×4 or 2×6. The beams may be suitably joined as by screws and glue or the like at their junctures, with optional nailing. Alternatively, the beams 70, 72, 74, and 76 may be of other materials, such as polycarbonate, resins, plastics, and the like, and may be formed by attaching separate beams together or may be formed as a single integrated molded unit. While curb assembly 10 is depicted in FIG. 1 as a rectangular configuration, such is for illustration purposed only, and it should be understood that the curb assembly may be of any regular or irregular geometric configuration.

Figure 2:
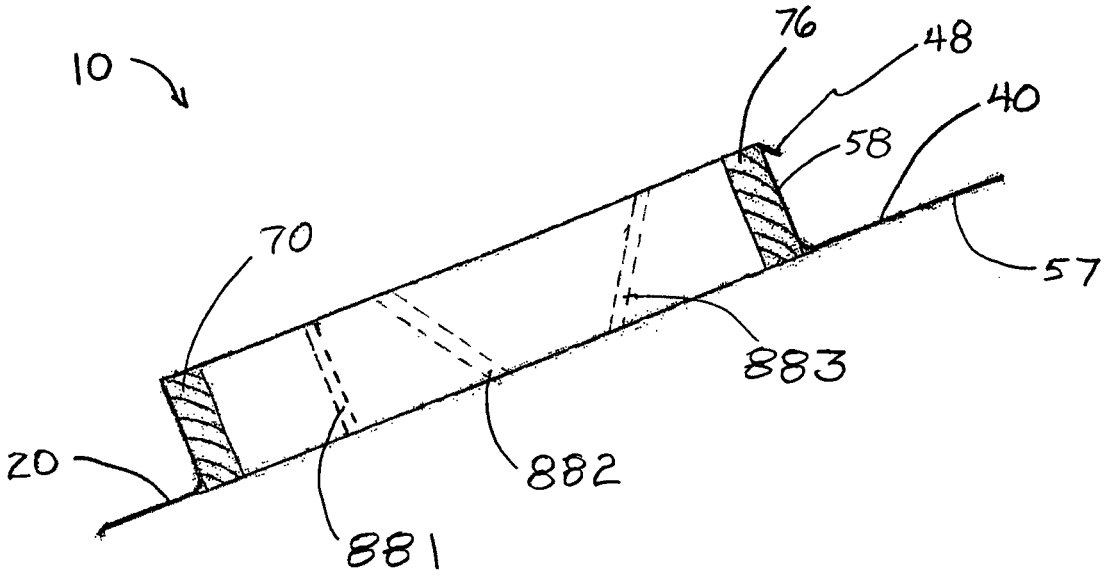
FIG. 2 is a cross-sectional view taken along line A-A in FIG. 1.
Figure 3:
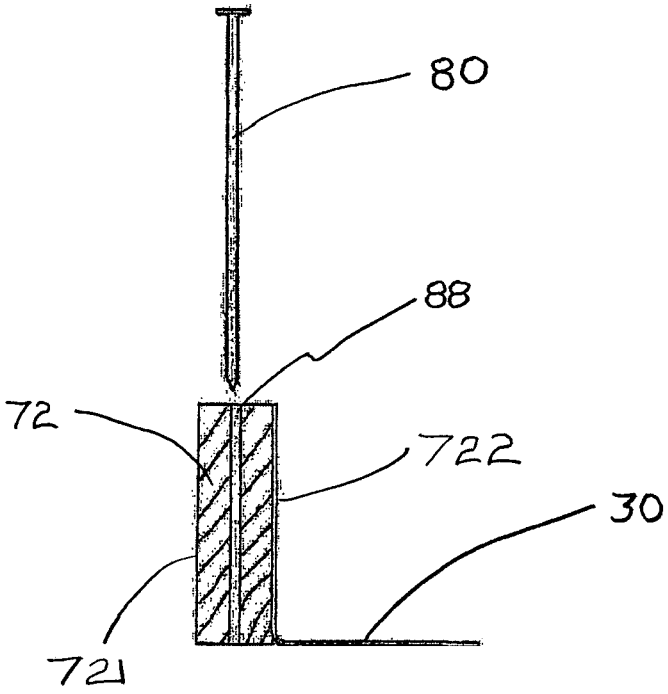
FIG. 3 is a cross-sectional view taken along line B-B in FIG. 1.

Within each of the beams 70, 72, 74, and 76 are disposed at least two fastening member receiving openings, apertures, or holes 88. The holes 88 are pre-drilled and center-bored into the beams. As depicted in for example FIG. 2, the holes 88, such as hole 881, may be bored straight through the beams 70, 72, 74, and 76 so as to be adapted for receipt of a roof fastening member, such as a nail or screw, generally perpendicular to the plane of the roof. Alternatively, the holes 88 may be oriented through the beams 70, 72, 74, and 76 at an acute angle to the plane of the roof, such as depicted with holes 882 and 883 in FIG. 2. Nevertheless, as shown in FIG. 3, holes 88, whether perpendicular holes 881 or angled holes 882/883, are disposed generally parallel to the inside surface 721 and the outside surface 722 of a beam such as right curb beam 72. So configured, the holes 88 allow for attachment directly into underlying roof truss members.

In a preferred embodiment, nails 80 are used through the holes 88 to attach the curb assembly 10 to the structure. Specifically, when the beams 70-76 are composed of 2×4 conventional lumber, 6" ring shank nails are preferred. When the beams 70, 72, 74, and 76 are constructed of conventional 2×6 lumber, 8" ring shank nails are preferred.

Disposed about the outside perimeter of the rectangular frame constructed of beams 70, 72, 74, and 76 is a flashing skirt, generally 15. Flashing skirt 15 may be understood to have an annular aspect, generally 16, carried by the curb beams, and a planar aspect, generally 17, adapted to reside upon the plane of a building roof upon installation. Flashing skirt 15 may be constructed of aluminum, tin, copper, elastomerics, plastics, or other suitable materials, or combinations thereof. The flashing skirt may be constructed of a plurality of individual flashing units, 20, 22, 24, 26, 30, 32, 40, 42, 44, and 46, and preferably have an L-shaped cross section and smooth surfaces both topside and underside to facilitate easy installation on shingled roofs and hot-mopped roofs. Specifically, one such a flashing unit is a sill flashing unit 20. The sill flashing unit 20 includes one leg of its L-shaped cross section to be carried by the sill curb beam 70 and the other leg to be carried upon the roof of the structure.

Proceeding counterclockwise around the curb assembly 10, attached to the sill flashing 20 is the right sill hip flashing unit 22. As shown in FIG. 1, right sill hip 22 includes leg 26, adapted to be attached to the right curb beam 72. The right sill hip 22 is preferably attached to the sill flashing 20 by means of a roll formed hem 50, providing a water-tight seal. Attached to the other side of the right sill hip 22 is a right side flashing unit 30. The lower end 53 of the right side flashing unit 30 is disposed atop the upper end 55 of the right sill hip 22 at the juncture 54, such that water flowing down the roof of the structure upon the right side flashing 30 will flow down the top of the right sill hip 22 rather than beneath it.

Above the right side flashing 30 is a right gutter shoulder unit 42. The lower edge 56 of the right gutter shoulder 42 is disposed atop the right side flashing unit 30 to allow the flow of water from the right gutter shoulder 42 to the top of the right side flashing 30. As shown in FIG. 1, the right gutter shoulder 42 includes an arm 46, adapted to be attached to the right curb beam 72.

Across the top of the curb assembly 10 is the top gutter unit 40. One leg 57 of the L-shaped cross section of the top gutter 40 extends upward on the roof deck, preferably about nine inches. The other leg 58 of the L-shaped cross section of the top gutter 40 is attached to gutter beam 76. As shown in FIG. 2, leg 58 may be further formed to create a gutter lip 48. The gutter lip 48 acts as a built-in water diverter, preventing water flowing down the roof to the curb assembly 10 from reaching the gutter curb beam 76.

The left gutter shoulder 44 is configured similar to the right gutter shoulder 42, and attached to the top gutter 40 with a roll formed hem 50. The left side flashing (not shown) is configured and attached like the right side flashing 30. Finally, the left sill hip 24 is configured and attached in like fashion to the right sill hip 22, with the connection between the left sill hip 24 and the sill flashing 20 being a roll formed hem 50.

The flashing skirt so configured is attached to the curb beams 70-76 by staples, screws, nails, and the like. In the preferred embodiment, no adhesives are used between the flashing skirt components and the frame beams, as such adhesives would interfere with and make more difficult the removal of the flashing skirt components should the roof including the curb assembly 10 be re-roofed in the future. It is likewise preferred that roofing shingles be nailed over all aspects of the flashing units residing in the plane of the roof, with the exception of the sill flashing 20, which should be disposed atop shingles adjacent to the lowermost aspects of the curb assembly 10.

Figure 4:
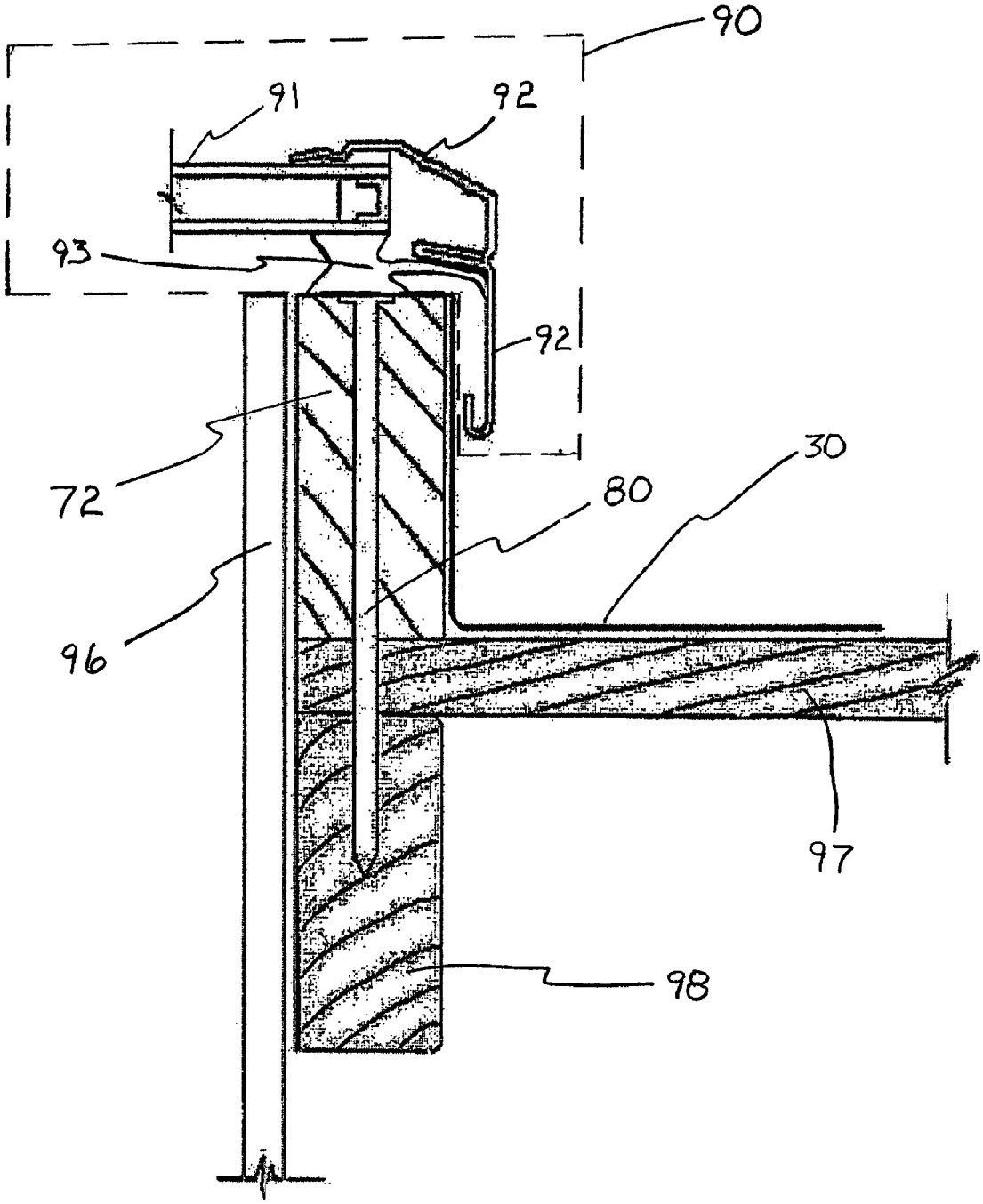
FIG. 4 is a diagrammatic sectional view showing one aspect of a pre-manufactured self-flashed curb assembly as installed in exemplary building with roof sheathing, roof truss, drywall, and skylight included for illustration.

FIG. 4 is a diagrammatic cross-sectional view of a portion of the curb assembly 10 installed upon an exemplary roof. As illustrated therein, the right curb beam 72 is affixed and attached to the roof decking 97 by means of the nail 80, penetrating through the cross section of the right curb beam 72, through the thickness of the roof decking 97, and into the roof truss 98. As shown, installation of the curb assembly 10 in such an environment does not interfere with the integrity or appearance of the sheetrock 96. For illustration, a portion of a typical skylight assembly 90 is shown in FIG. 4, including the glass or glazing 91, the skylight frame 92, and a sealing gasket 93. As illustrated, the skylight frame 92 extends over and beyond the right side flashing 30, to provide a weatherproof, watertight system.

Various modifications and variations can be made in the embodiments of the present invention without departing from the scope and spirit of the invention. It is intended that the present invention include such modifications and variations as come within the scope of the appended claims and their equivalents.

What is claimed is:

1. A pre-manufactured self-flashed curb assembly for rooftop daylighting systems, comprising:

a wall structure, said wall structure having an outside surface defining a perimeter and an inside surface defining a curb opening, said wall structure between said outside and inside surfaces defining a plurality of fastener openings therein parallel with said outside and inside surfaces oriented for receipt of respective fasteners therethrough;

flashing secured around said perimeter of said wall structure and secured thereto, said flashing including a lower portion extending outwardly from said wall structure therearound, said outwardly extending portion of said flashing being generally parallel to a roof when said curb is installed thereon, said fastener openings extending through said flashing for securing said respective fasteners therethrough into an underlying roof truss.

2. The pre-manufactured self-flashed curb assembly of claim 1, in which said wall structure is wood.

3. The pre-manufactured self-flashed curb assembly of claim 1, in which said wall structure is metal.

4. The pre-manufactured self-flashed curb assembly of claim 1, in which said wall structure is polycarbonate.

5. The pre-manufactured self-flashed curb assembly of claim 1, in which said fastener openings are adapted for receipt of ring shank nails.

6. The pre-manufactured self-flashed curb assembly of claim 1, in which said flashing comprises a plurality of interconnected flashing members.

7. The pre-manufactured self-flashed curb assembly of claim 6, in which the flashing members are at least one member of the group aluminum, tin, copper, plastic, and elastomerics.

8. The pre-manufactured self-flashed curb assembly of claim 6, in which one of said flashing members is a top gutter, said top gutter further including a gutter lip.

9. A pre-manufactured self-flashed curb assembly for rooftop daylighting systems, comprising:

a rectangular curb, said curb including a first standard and a second standard parallel to said first standard, said curb further including third and fourth standards parallel therebetween and perpendicular to said first and second standards, said standards defining an opening therein of predetermined dimensions and an outside perimeter therearound;

said standards each including at least two apertures therethrough for receipt of roof attachment fasteners, said apertures disposed at least generally perpendicular to said rectangular curb through said standards; and a flashing skid, said flashing skirt including an annular aspect and a planar aspect, said annular aspect carried by said rectangular frame about said outside perimeter, said planar aspect parallel to said rectangular frame and adapted for attachment to a building rooftop, said apertures extending through a portion of said flashing skirt for securing said roof attachment fasteners into said building rooftop.

10. The pre-manufactured self-flashed curb assembly of claim 9, in which said first, second, third, and fourth beams are wood.

11. The pre-manufactured self-flashed curb assembly of claim 9, in which said first, second, third, and fourth beams are metal.

12. The pre-manufactured self-flashed curb assembly of claim 9, in which said first, second, third, and fourth beams are polycarbonate.

13. The pre-manufactured self-flashed curb assembly of claim 9, in which said apertures are adapted for receipt of ring shank nails.

14. The pre-manufactured self-flashed curb assembly of claim 9, in which said flashing skirt comprises a plurality of interconnected flashing members.

15. The pre-manufactured self-flashed curb assembly of claim 14, in which the flashing members are at least one member of the group aluminum, tin, copper, plastic, and elastomerics.

16. The pre-manufactured self-flashed curb assembly of claim 14, in which one of said flashing members is a top gutter, said top gutter further including a gutter lip.

17. A pre-manufactured self-flashed replacement curb assembly for rooftop daylighting systems with interior finishing board pre-existing within the opening thereof, comprising:

a rectangular frame having an outside perimeter, said frame including at least four beams, each said beam having a first end and an opposed second end, said first end of said first beam perpendicularly connected to said second end of said second beam, said first end of said second beam perpendicularly connected to said second end of said third beam, said third beam disposed parallel to said first beam, said first end of said third beam perpendicularly connected to said second end of said fourth beam, said second end of said fourth beam perpendicularly connected to said second end of said first beam, each said beam including at least two apertures therethrough perpendicular to said rectangular frame adapted for receipt of elongated roof attachment fasteners, said first and third beam and said second and fourth beam adapted for receipt therebetween of said pre-existing finishing board;

a plurality of flashing units, each said flashing unit having L-shaped cross-sections defining two legs, said at least two apertures extending through said flashing units, including:

a sill flashing, said one leg of said sill flashing unit carried by said first beam;

a right flashing unit, said one leg of said right flashing unit carried by said second beam, said right flashing unit in waterproof attachment to said sill flashing unit;

a top gutter, said one leg of said top gutter carried by said third beam, said top gutter in waterproof attachment to said right flashing unit; and a left flashing unit, said one leg of said left flashing unit carried by said fourth beam, said left flashing unit in waterproof attachment to said top gutter and to said sill flashing, wherein said at least two apertures defined in said beams and said flashing units are adapted for receipt of respective roof attachment fasteners for attaching said pre-manufactured self-flashed replacement curb assembly on a building rooftop.

18. The pre-manufactured self-flashed curb assembly of claim 17, in which said first, second, third, and fourth beams are of at least member of the group consisting of wood, metal, and polycarbonate.

19. The pre-manufactured self-flashed curb assembly of claim 17, in which the flashing members are at least one member of the group aluminum, tin, copper, plastic, and elastomerics.

20. The pre-manufactured self-flashed curb assembly of claim 17, in which said top gutter includes a gutter lip.

21. A pre-manufactured self-flashed curb assembly for rooftop daylighting systems, comprising:

a wall structure, said wall structure having an outside surface defining a perimeter and an inside surface defining a curb opening, said wall structure between said outside and inside surfaces defining a plurality of fastener openings therein parallel with said outside and inside surfaces oriented for receipt of respective fasteners therethrough;

flashing including a gutter lip secured around said perimeter of said wall structure and secured thereto, said flashing including a lower portion extending outwardly from said wall structure therearound, said outwardly extending portion of said flashing being generally parallel to a roof when said curb is installed thereon, said fastener openings extending through said flashing for securing said respective fasteners into an underlying roof truss.

* * * * *